US005526535A

United States Patent [19]

Dobrzenski

[11] Patent Number: 5,526,535

[45] Date of Patent: Jun. 18, 1996

[54] FISHING VEST WITH HINGED POCKETS

[76] Inventor: Theodore R. Dobrzenski, 5635 Mapleton Dr., Utica, N.Y. 13502

[21] Appl. No.: 383,452

[22] Filed: Feb. 3, 1995

[51] Int. Cl.[6] ..... A41D 1/04; A41D 27/20

[52] U.S. Cl. ..... 2/102; 2/94; 2/247; 2/250

[58] Field of Search ..... 2/102, 69, 108, 2/48, 51, 247, 249, 255, 93–95, 250–252

[56] References Cited

U.S. PATENT DOCUMENTS

| | | | |
|---|---|---|---|
| 2,448,416 | 8/1948 | Carter | 2/94 |
| 2,678,447 | 5/1954 | Bracken | 2/94 |
| 2,717,391 | 9/1955 | Bracken | 2/94 |
| 4,637,075 | 1/1987 | Ingrisano et al. | 2/247 |
| 5,072,456 | 12/1991 | Elin | 2/94 |
| 5,247,707 | 9/1993 | Parker et al. | 2/94 |
| 5,394,565 | 3/1995 | Stewart et al. | 2/108 |

*Primary Examiner*—C. D. Crowder
*Assistant Examiner*—Gloria Hale

[57] ABSTRACT

A fishing vest with hinged pockets comprising: a vest shaped in a generally rectangular configuration with a front segment and a rear segment, the front segment including releasable coupling devices, the front and rear segments of the vest including arm and neck slots, the vest including at least one upper pocket including coupling devices to permit the placement of fishing accessories therein, the vest also having at least one hinged pocket including a rigid rotatable member to permit the perpendicular extension of the pocket with respect to the vest in the open orientation, each rigid rotatable member being positioned vertically and coupled to the vest in the closed orientation, the vest including at least one hinged fishing box adapted to retain various fishing accessories, each fishing box being positioned in a hinged pocket to provide users with easy access to fishing accessories when needed.

7 Claims, 4 Drawing Sheets

FISHING VEST WITH HINGED POCKETS

BACKGROUND OF THE INVENTION

1. Field of the Invention

The present invention relates to a fishing vest with hinged pockets and more particularly pertains to easily accessing fishing accessory boxes stored within the hinged pockets of the apparatus.

2. Description of the Prior Art

The use of multi-purpose carrier vests is known in the prior art. More specifically, multi-purpose carrier vests heretofore devised and utilized for the purpose of storing various items in the pockets of the vests are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,063,614 to McSheffery a reversible garment having detachable pockets.

U.S. Pat. No. 4,669,127 to Swanson discloses a pack vest.

U.S. Pat. No. 4,369,526 to Clutts discloses a utility vest.

U.S. Pat. No. 4,998,654 to Brazek et al. discloses a article carrier vest.

Lastly, U.S. Pat. No. 4,723,695 to Farber discloses a fisherman's garment and landing net scabbard.

In this respect, the fishing vest with hinged pockets according to the present invention substantially departs from the conventional concepts and designs of the prior art, and in doing so provides an apparatus primarily developed for the purpose of easily accessing fishing accessory boxes stored within the hinged pockets of the apparatus.

Therefore, it can be appreciated that there exists a continuing need for a new and improved fishing vest with hinged pockets which can be used for easily accessing fishing accessory boxes stored within the hinged pockets of the apparatus. In this regard, the present invention substantially fulfills this need.

SUMMARY OF THE INVENTION

In view of the foregoing disadvantages inherent in the known types of multi-purpose carrier vests now present in the prior art, the present invention provides an improved fishing vest with hinged pockets. As such, the general purpose of the present invention, which will be described subsequently in greater detail, is to provide a new and improved fishing vest with hinged pockets and method which has all the advantages of the prior art and none of the disadvantages.

To attain this, the present invention essentially comprises a new and improved fishing vest with hinged pockets comprising, in combination: a vest formed in a generally rectangular configuration with a back segment and two opposing front segments, the back segment including two concave arm slots, the back and front segments each having an inner surface and an outer surface, the front and back segments being woven together to form the vest; a large generally rectangular shaped back pocket being positioned upon the outer surface of the back segment, the upper edge, lower edge and one vertical side edge of the back pocket being fixedly attached to the back segment of the vest, one vertical side edge being open and including a retractable flap with coupling means affixed thereto, the back pocket permitting side access to items stored therein; the opposing front segments each being formed in a generally rectangular configuration with an upper portion, a lower portion and a central portion therebetween, each front segment including a linear inner edge and an outer edge having a concave arm slot, the upper portion of each front segment having an angled collar to permit the passage of the user's head therethrough, the linear inner edge of each front segment including coupling means affixed thereto; a small upper pocket being affixed to the upper portion of each front segment, the uppermost extent of each upper pocket having a retractable flap including coupling means, each upper pocket including a generally semi-circular shaped ring affixed thereto, the ring adapted to permit affixation of fishing accessories thereto, the flap of one upper pocket including a lamb's wool pad to enable the user to retain fly hooks and other fishing accessories therein; a large hinged pocket being affixed to the lower portion of each front segment, an intermediate sized hinged pocket being affixed to the central portion of each front segment, each hinged pocket including an upper flap with coupling means and a hinge device having a stationary vertical section and a moveable L-shaped section, each stationary vertical section including coupling means and being releasably coupled within a front segment of the vest, the coupling means permitting easy removal of the vertical segment when laundering of the vest is required, the lowermost extent of the stationary vertical segment including a cylindrical hinge, the L-shaped section having a short region with a free end and a long region with a free end, the short and long regions being affixed perpendicular to each other, the free end of the short region being rotatably coupled to the hinge, the long region having inner and outer surfaces including coupling means, the hinge permitting ninety degree rotation of the L-shaped section with respect to the vertical section, in the closed orientation each long region being positioned vertically and coupled to its corresponding upper flap, in the open orientation each long segment being positioned horizontally, a hinged plastic fishing box being coupled to the long region of each L-shaped section the fishing box having a hinged cover and adapted to retain a plurality of fishing accessories therein, the hinged pockets of the vest permitting efficient access to fishing accessories stored therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fishing vest with hinged pockets which has all of the advantages of the prior art multi-purpose carrier vests and none of the disadvantages.

It is another object of the present invention to provide a new and improved fishing vest with hinged pockets which may be easily and efficiently manufactured and marketed.

It is further object of the present invention to provide a new and improved fishing vest with hinged pockets which is of durable and reliable constructions.

An even further object of the present invention is to provide a new and improved fishing vest with hinged pockets which is susceptible of a low cost of manufacture with regard to both materials and labor, and which accordingly is then susceptible of low prices of sale to the consuming public, thereby making such fishing vest with hinged pockets economically available to the buying public.

Still yet another object of the present invention is to provide a new and improved fishing vest with hinged pockets which provides in the apparatuses and methods of the prior art some of the advantages thereof, while simultaneously overcoming some of the disadvantages normally associated therewith.

Still another object of the present invention is to easily access fishing accessory boxes stored within the hinged pockets of the apparatus.

Lastly, it is an object of the present invention to provide a new and improved a fishing vest with hinged pockets comprising: a vest shaped in a generally rectangular configuration with a front segment and a rear segment, the front segment including releasable coupling devices, the front and rear segments of the vest including arm and neck slots, the vest including at least one upper pocket including coupling devices to permit the placement of fishing accessories therein, the vest also having at least one hinged pocket including a rigid rotatable member to permit the perpendicular extension of the pocket with respect to the vest in the open orientation, each rigid rotatable member being positioned vertically and coupled to the vest in the closed orientation, the vest including at least one hinged fishing box adapted to retain various fishing accessories, each fishing box being positioned in a hinged pocket to provide users with easy access to fishing accessories when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
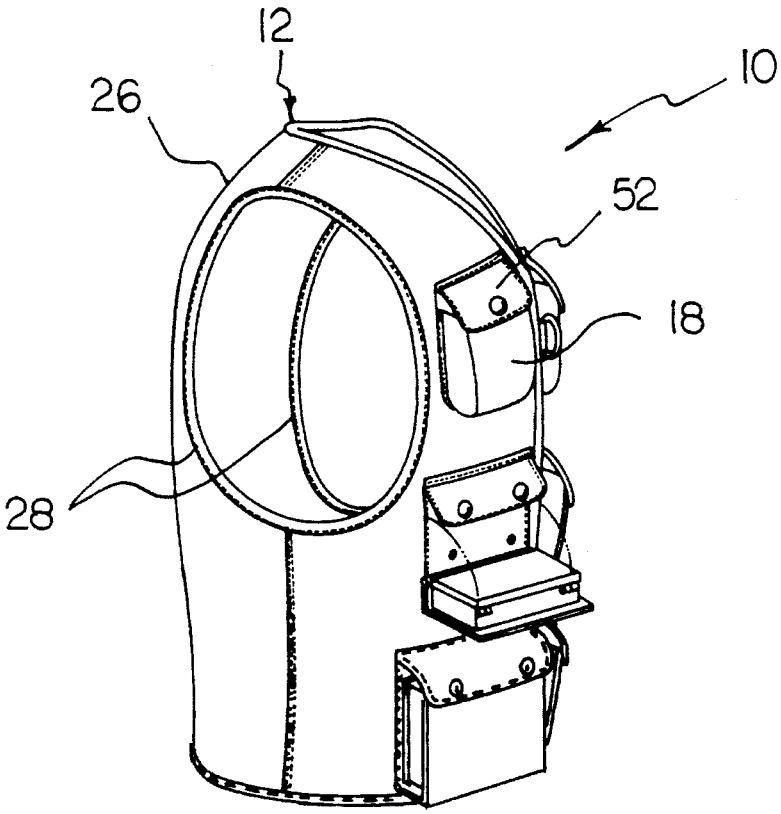
FIG. 1 is a perspective view of the preferred embodiment of the fishing vest with hinged pockets constructed in accordance with the principles of the present invention.

With reference now to the drawings, and in particular to FIG. 1 thereof, the preferred embodiment of the new and improved fishing vest with hinged pockets embodying the principles and concepts of the present invention and generally designated by the reference numeral 10 will be described.

The present invention, the fishing vest with hinged pockets 10 is comprised of a plurality of components. Such components in their broadest context include a vest 12, a back pocket 14, a opposing front segments 16, a two upper pockets 18, two large hinged pockets 20, and two intermediate hinged pockets 22. Such components are individually configured and correlated with respect to each other so as to attain the desired objective.

Figure 2:
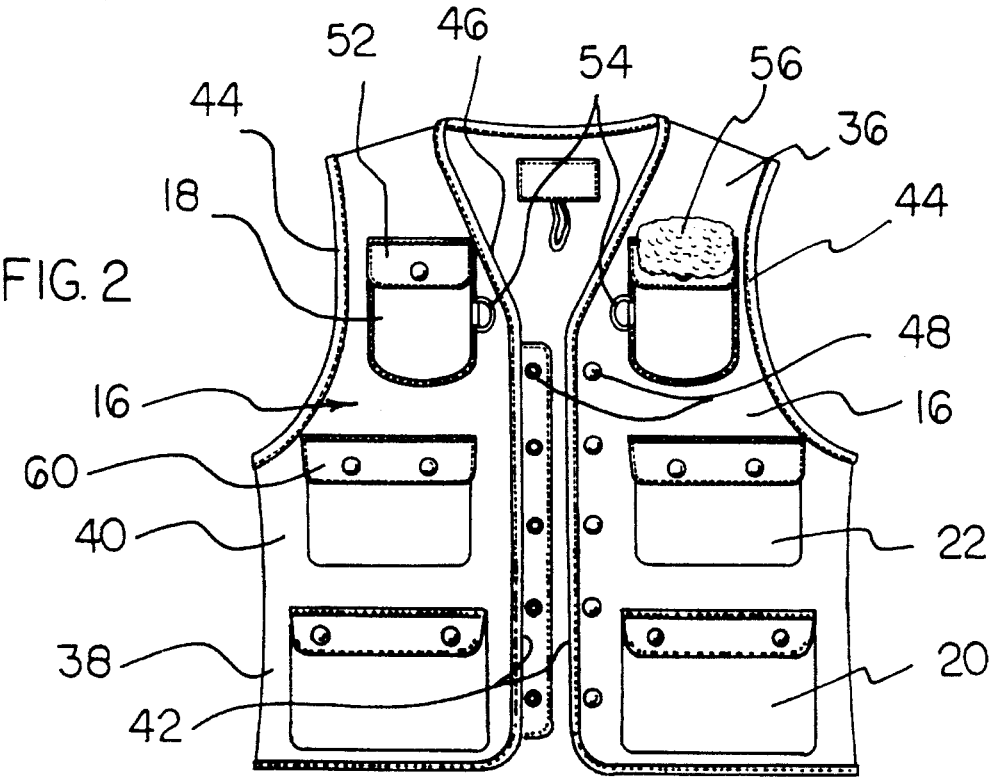
FIG. 2 is a front perspective view of the apparatus shown in FIG. 1.
Figure 3:
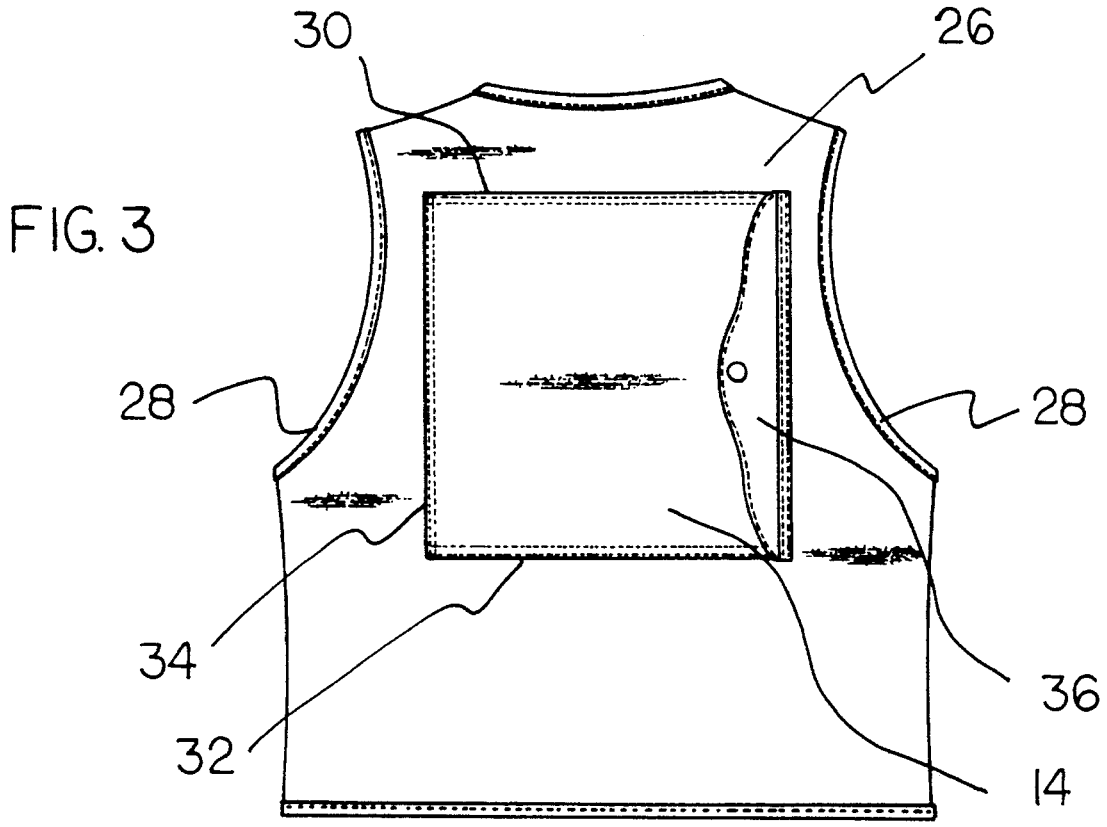
FIG. 3 is a rear perspective view of the apparatus shown FIG. 1.

More specifically, the vest 12 is formed in a generally rectangular configuration with a back segment 26 and two opposing front segments 16. The vest may be fabricated from a plurality of different sturdy materials such as canvass, leather, suede, etc. The back segment includes two concave arm slots 28. The back and front segments each have an inner surface and an outer surface. The front and back segments are woven together to form the vest. Note FIGS. 1–3.

A large generally rectangular shaped back pocket 14 is positioned upon the outer surface of the back segment. The upper edge 30, lower edge 32 and one vertical side edge 34 of the back pocket are fixedly attached to the back segment of the vest. One vertical side edge is open and includes a retractable flap 36 with coupling means affixed thereto. The back pocket permits side access to items stored within it. The large size of the pocket permits the retainment of large items such as handguns, gloves, boots etc. The side orientation of the pocket permits users to reach back and remove items without having to first remove the vest. Note FIG. 3.

The opposing front segments 16 are each formed in a generally rectangular configuration with an upper portion 36, a lower portion 38 and a central portion 40 therebetween. Each front segment includes a linear inner edge 42 and an outer edge with a concave arm slot 44. The upper portion of each front segment has an angled collar 46 to permit the comfortable passage of the user's head through it. The linear inner edge of each front segment includes coupling means 48 affixed to it. In the preferred embodiment of the apparatus the coupling means are zippers to snugly secure the vest around the user. In alternative embodiments of the apparatus the coupling means are buttons and grommets or snap devices. Note FIG. 2.

Figure 5:
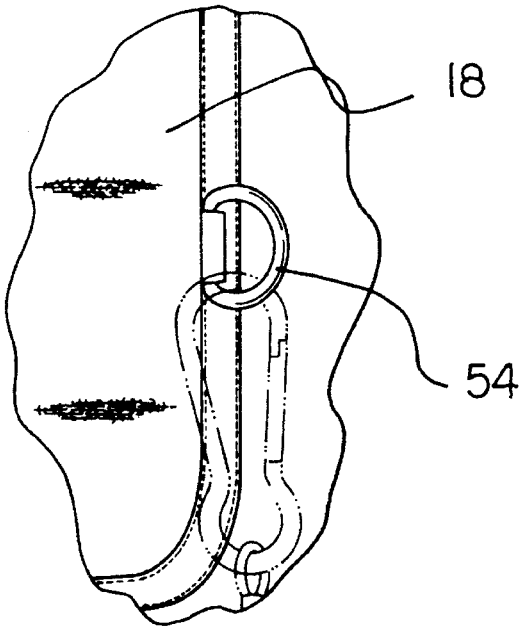
FIG. 5 is an exploded perspective view of an upper pocket ring of the apparatus.
Figure 6:
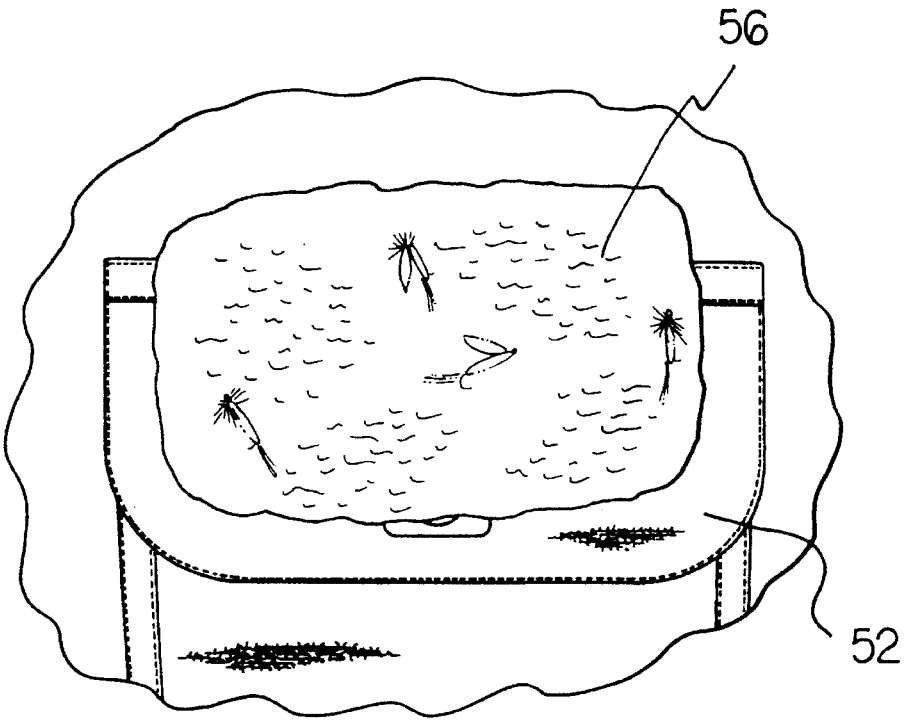
FIG. 6 is an exploded perspective view of the lamb's wool pad positioned on an upper pocket of the apparatus.

A small upper pocket 18 is affixed to the upper portion of each front segment. The uppermost extent of each upper pocket has a retractable flap 52 which includes coupling means. The coupling means are snap devices in the preferred embodiment. Each upper pocket includes a generally semi-circular shaped ring 54 affixed to it. The ring is adapted to permit the affixation of fishing accessories to it. The rings can be used with lock means as shown in FIG. 5, tied to fishing line, or used to temporarily hang fish hooks, among other uses. The flap of one upper pocket includes a lamb's wool pad 56 to enable the user to retain fly hooks and other fishing accessories within it. This feature is particularly useful for safely retaining sharp fish hooks. The thick lambs wool provides sufficient clearance area to prevent fish hooks from piercing the vest. Note FIGS. 2 and 6.

Figure 4:
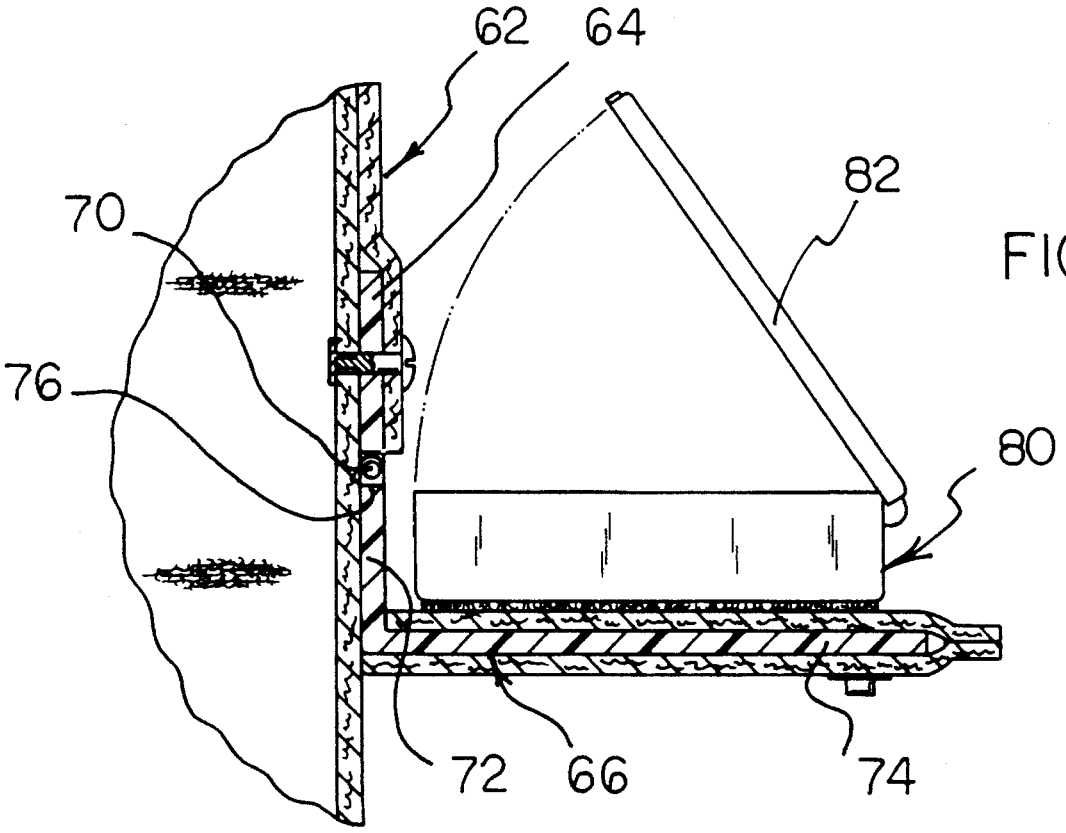
FIG. 4 is a cross sectional view of a hinged pocket in the open position with a fishing box affixed thereto.

A large hinged pocket 20 is affixed to the lower portion of each front segment. An intermediate sized hinged pocket 22 is affixed to the central portion of each front segment. The differently sized hinged pockets are adapted to store and organize different types of fishing accessories. Each hinged pocket includes an upper flap 60 with coupling means. Snap devices are used in the preferred embodiment of the apparatus. Note FIGS. 2 and 4.

Each hinged pockets also includes a hinge device 62 with a stationary vertical section 64 and a moveable L-shaped section 66. Each stationary vertical section includes coupling means and is releasably coupled within a front segment of the vest. In the preferred embodiment the vertical section measures about four inches in length. The vertical section is retained within the vest with elastic thread for easy removability. In an alternate embodiment the vertical sections are retained with rigid leather or vinyl strips. The coupling means permit easy removal of the vertical segment when laundering of the vest is required. The lowermost extent of the stationary vertical segment includes a cylindrical hinge 70. Note FIG. 2 and 4.

The L-shaped section 66 has a short region 72 with a free end 76 and a long region 74 with a free end. The short and long regions are affixed perpendicular to each other. The free end 76 of the short region is rotatably coupled to the hinge. The long region has inner and outer surfaces which include coupling means. The coupling means on the outer surface are snap devices adapted to be coupled to the upper flaps. The coupling means on the inner surface are hook and loop fastener velcro adapted to be coupled to the fishing boxes of the apparatus. Note FIG. 4.

The hinge 70 permits ninety degree rotation of the L-shaped section with respect to the vertical section. In the closed orientation each long region is positioned vertically and is coupled to its corresponding upper flap. In this orientation the fishing boxes are closed and safely secured within the pockets. In the open orientation each long segment is positioned horizontally. A hinged plastic fishing box 80 is coupled to the long region of each L-shaped section. The fishing box has a hinged cover 82 and is adapted to retain a plurality of fishing accessories within it. The hinged pockets of the vest permit efficient access to fishing accessories stored within it. Note FIG. 4.

When the coupling means of the pocket are released the hinge device opens downward to a 90 degree angle providing a flat platform. The hinged pockets hold the user's box of lures or flies in a stable horizontal orientation enabling him to easily find and pick out the desired accessory without a bit of fumbling. The fishing accessory boxes can then be easily opened with just one hand. This represents a significant improvement over other fishing methods in that the hooks and other accessories can be safely and efficiently removed from the fishing boxes while the user controls a fishing rod with his opposite hand. In the primary embodiment of the apparatus only one fishing box is positioned in each hinged pocket. In alternative embodiments of the apparatus two or more fishing boxes may be included in each pocket. Additionally, the lure boxes can be easily interchanged.

Figure 7:
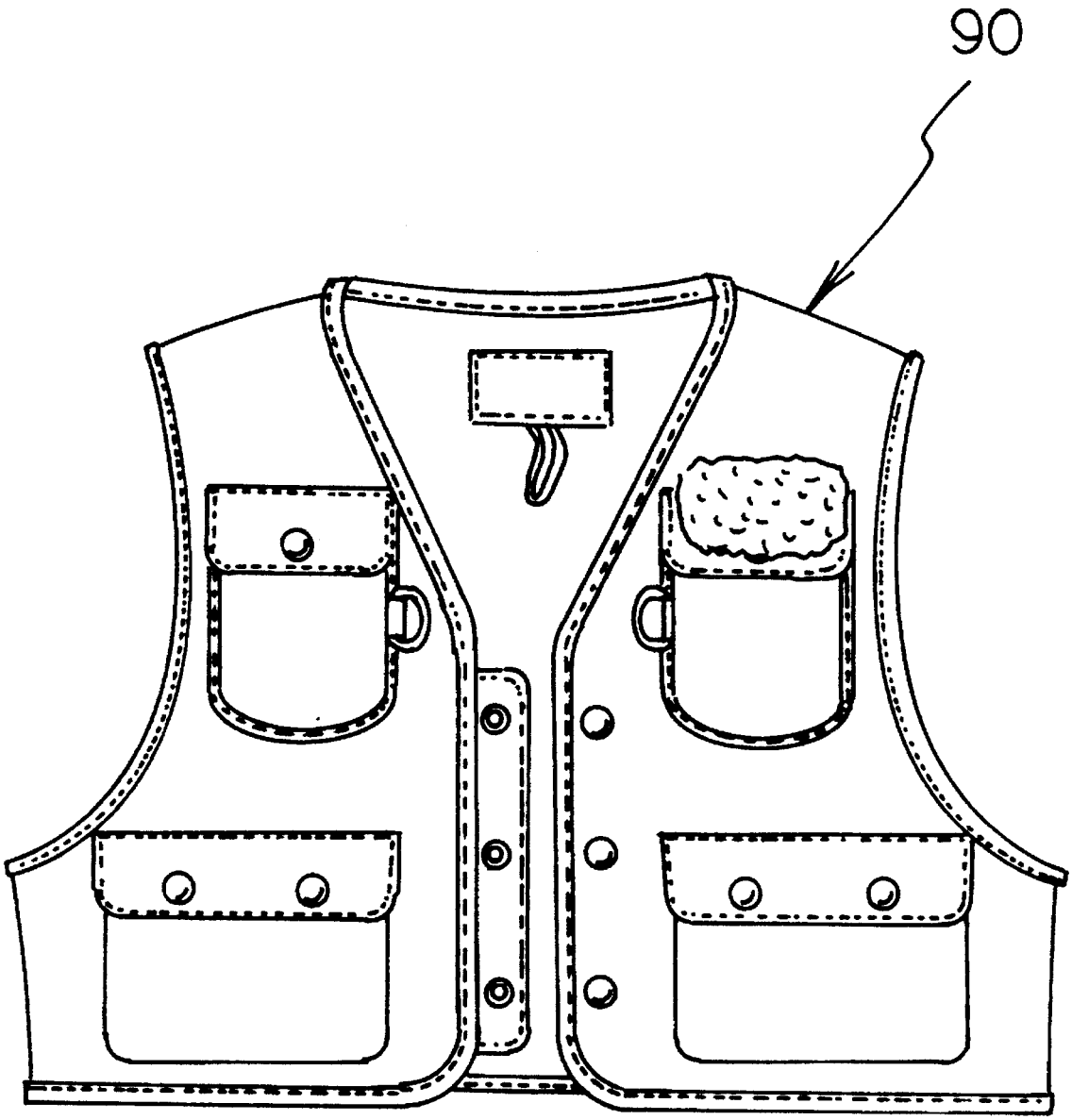
FIG. 7 is a perspective view of a shorter alternative embodiment of the apparatus adapted for use in deep water and cold weather conditions.

In an alternative embodiment of the apparatus the vest 90 has a short vertical length and includes only two hinged pockets. The interior of the vest 90 also includes insulated material. This shorter version of the apparatus is adapted to be used when fishing in deep water or cold weather conditions. Note FIG. 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A fishing vest with hinged pockets comprising, in combination:

a vest formed in a generally rectangular configuration with a back segment and two opposing front segments, the back segment including two concave arm slots, the back and front segments each having an inner surface and an outer surface, the front and back segments being woven together to form the vest;

a large generally rectangular shaped back pocket being positioned upon the outer surface of the back segment, an upper edge, a lower edge and a vertical side edge of the back pocket being fixedly attached to the back segment of the vest, another vertical side edge being open and including a retractable flap with coupling means affixed thereto, the back pocket permitting side access to items stored therein;

the opposing front segments each being formed in a generally rectangular configuration with an upper portion, a lower portion and a central portion therebetween, each front segment including a linear inner edge and an outer edge having a concave arm slot, the upper portion of each front segment having an angled collar to permit the passage of the user's head therethrough, the linear inner edge of each front segment including coupling means affixed thereto;

a small upper pocket being affixed to the upper portion of each front segment, the uppermost extent of each upper pocket having a retractable flap including coupling means, each upper pocket including a generally semi-circular shaped ring affixed thereto, the ring adapted to permit affixation of fishing accessories thereto, the flap of one upper pocket including a lamb's wool pad to enable the user to retain fly hooks and other fishing accessories therein; and a large hinged pocket being affixed to the lower portion of each front segment, an intermediate sized hinged pocket being affixed to the central portion of each front segment, each hinged pocket including an upper flap with coupling means and a hinge device having a stationary vertical section and a moveable L-shaped section, each stationary vertical section including coupling means and being releasably coupled within a front segment of the vest, the coupling means permitting easy removal of the vertical segment when laundering of the vest is required, the lowermost extent of the stationary vertical segment including a cylindrical hinge, the L-shaped section having a short region with a free end and a long region with a free end, the short and long regions being affixed perpendicular to each other, the free end of the short region being rotatably coupled to the hinge, the long region having inner and outer surfaces including coupling means, the hinge permitting ninety degree rotation of the L-shaped section with respect to the vertical section, in the closed orientation each long region being positioned vertically and coupled to its corresponding upper flap, in the open orientation each long segment being positioned horizontally, a hinged plastic fishing box being coupled to the long region of each L-shaped section the fishing box having a hinged cover and adapted to retain a plurality of fishing accessories therein, the hinged pockets of the vest permitting efficient access to fishing accessories stored therein.

2. A fishing vest with hinged pockets comprising:

a vest shaped in a generally rectangular configuration with a front segment and a rear segment, the front segment including releasable coupling devices, the front and rear segments of the vest including arm and neck slots, the vest including at least one upper pocket including coupling devices to permit the placement of fishing accessories therein, the vest also having at least one hinged pocket including a rigid rotatable member to permit the perpendicular extension of the pocket with respect to the vest in the open orientation, each rigid rotatable member being positioned vertically and coupled to the vest in the closed orientation, the vest including at least one hinged fishing box adapted to retain various fishing accessories, each fishing box being positioned in a hinged pocket to provide users with easy access to fishing accessories when needed.

3. The fishing vest as set forth in claim 2 wherein four hinged pockets are included with the apparatus, the pockets adapted to store a plurality of different types of fishing equipment.

4. The fishing vest as set forth in claim 2 wherein the vest has a short vertical length and includes only two hinged pockets, the interior of the vest including insulated material, the apparatus adapted for use when fishing in deep water or during cold weather conditions.

5. The fishing vest as set forth in claim 2 wherein the fishing boxes are coupled within the hinged pockets with hook and loop fastener.

6. The fishing vest as set forth in claim 2 wherein a large utility pocket is positioned upon the back segment, the large pocket having an opening including coupling means on one vertical side edge to permit side access by the user.

7. The fishing vest as set forth in claim 2 wherein one of the upper pockets includes cushioned coupling means to permit retention of sharp fishing hooks and other fishing accessories therein.

* * * * *